United States Patent [19]

Soehngen et al.

[11] 4,020,145

[45] Apr. 26, 1977

[54] CARBON FIBER PRODUCTION

[75] Inventors: John W. Soehngen, Berkeley Heights; Albert G. Williams, West Orange, both of N.J.

[73] Assignee: Celanese Corporation, New York, N.Y.

[22] Filed: Mar. 12, 1975

[21] Appl. No.: 557,519

Related U.S. Application Data

[63] Continuation of Ser. No. 324,695, Jan. 18, 1973, abandoned.

[52] U.S. Cl. ..... 423/447.4; 264/29.2

[51] Int. Cl.[2] ..... C01B 31/07

[58] Field of Search ..... 264/29.2; 423/447.1, 423/447.2, 447.4, 447.5, 447.6, 447.7

[56] References Cited

UNITED STATES PATENTS

| | | | |
|---|---|---|---|
| 3,639,140 | 2/1972 | Miyamichi | 117/46 CB |
| 3,723,609 | 3/1973 | Mansmann et al. | 264/29 |
| 3,784,679 | 1/1974 | Chiche | 423/447 |
| 3,852,428 | 12/1974 | Powell et al. | 264/29 |
| 3,928,544 | 12/1975 | Yokota et al. | 264/29 |

FOREIGN PATENTS OR APPLICATIONS

| | | | |
|---|---|---|---|
| 2,207,746 | 8/1972 | Germany | 423/447 |
| 47-24184 | 7/1972 | Japan | 423/447 |
| 47-2411 | 1/1972 | Japan | 423/447 |
| 47-10252 | 3/1972 | Japan | 423/447 |

*Primary Examiner*—Jay H. Woo

[57] ABSTRACT

An improved process is provided for producing a pyrolyzed carbonaceous filamentary material. The process utilizes a novel precursor of relatively high carbon content comprising a homogeneous blend of polystyrene and a substantial proportion of inexpensive pitch. Following melt spinning the resulting filamentary material is hot drawn, thermally stabilized, and carbonized. The thermal stabilization step of the process comprises the sulfonation of the previously hot drawn filamentary material. The thermally stabilized filamentary material optionally may be carbonized and graphitized. Processing difficulties commonly associated with a pitch precursor are effectively overcome.

21 Claims, No Drawings

CARBON FIBER PRODUCTION

This is a continuation of application Ser. No. 324,695, filed Jan. 18, 1973, now abandoned.

BACKGROUND OF THE INVENTION

In the search for high performance materials, considerable interest has been focused upon pyrolyzed carbonaceous fibers. Graphite fibers are defined herein as fibers which consist essentially of carbon and have a predominant X-ray diffraction pattern characteristic of graphite. Amorphous carbon fibers or carbonized fibers, on the other hand, are defined as fibers in which the bulk of the fiber weight can be attributed to carbon and which exhibit an essentially amorphous X-ray diffraction pattern. Graphite fibers generally have a higher Young's modulus than do amorphous carbon fibers and, in addition, are more highly electrically and thermally conductive.

Industrial high performance materials of the future are projected to make substantial utilization of fiber reinforced composites, and pyrolyzed carbonaceous fibers theoretically have among the best properties of any fiber for use as high strength reinforcement. Among these desirable properties are corrosion and high temperatures resistance, low density, high tensile strength, and high modulus. Graphite is one of the very few known materials whose tensile strength increases with temperature. A common technique employed in the production of composites involves the filament winding or molding of articles of the desired configuration utilizing continuous lengths of pyrolyzed carbonaceous filamentary materials having a coating of a resinous material which ultimately serves as the matrix in the resulting article. Uses for such fiber reinforced composites include aerospace structural components, rocket motor casings, deep-submergence vessels and ablative materials for heat shields on re-entry vehicles.

In the prior art organic fibrous materials such as pitch, cellulosics, acrylics, polyamides, polybenzimidazoles, polyvinyl alcohol, etc., have commonly served as the starting material in the production of pyrolyzed carbonaceous fibers. Such prior art conversion technqiues commonly have employed a thermal stabilization step prior to carbonization or carbonization and graphitization. Such thermal stabilization step commonly has been conducted either by chemical means or by moderate heating for a sufficient time in an appropriate gaseous atmosphere (i.e., at about 200 to 400° C) as is well known to those skilled in the art. The stabilized fibrous material next has been carbonized by heating in an inert atmosphere at a more highly elevated temperature wherein elements present in the same other than carbon are substantially evolved.

Representative disclosures involving the utilization of a pitch precursor include U.S. Pat. Nos. 3,595,946; 3,629,379; 3,639,953; and 3,702,054.

Representative disclosures involving the utilization of a cellulosic precursor include U.S. Pat. Nos. 3,011,981; 3,107,152; 3,116,975; and 3,305,315.

Representative disclosures involving the utilization of an acrylic precursor include U.S. Pat. Nos. 3,508,874; 3,539,295; 3,650,668; and 3,656,883.

Representative disclosures involving the utilization of a polyamide precursor include U.S. Pat. No. 3,547,584, and Belgian Patent Nos. 719,961; 720,356; and 722,216.

Representative disclosures involving the utilization of a polybenzimidazole precursor include U.S. Pat. Nos. 3,449,077, and 3,528,774.

Representative disclosures involving the utilization of a polyvinyl alcohol precursor include U.S. Pat. Nos. 3,427,120, and 3,488,151.

Many of the precursor materials utilized in the prior art have contained a substantial proportion of elements other than carbon which must be evolved during the carbonization reaction. Such precursor materials are commonly expensive and yield a decreased amount of pyrolyzed carbonaceous product because of a high material loss through the evolution of non-carbon components. Starting materials such as pitch are recognized to be inexpensive and to possess an extremely high carbon content; however, such materials have been known to present severe processing constraints because of difficulties commonly encountered when handling the same. For instance, pitch filamentary materials are commonly of low strength and brittle in nature, and extremely prone to damage.

It is an object of the invention to provide an improved process for the formation of pyrolyzed carbonaceous filamentary materials.

It is an object of the invention to provide an improved process for the formation of a pyrolyzed carbonaceous filamentary material which utilizes a relatively inexpensive precursor material of a relatively high carbon content.

It is an object of the invention to provide an improved process for the formation of a pyrolyzed carbonaceous filamentary material which utilizes a precursor material which may be readily melt spun.

It is another object of the invention to provide an improved process for the formation of a pyrolyzed carbonaceous filamentary material wherein the evolution of non-carbon off-gases during the carbonization reaction is minimized.

It is another object of the invention to provide an improved process for the formation of a pyrolyzed carbonaceous filamentary material which is substantially free of voids.

It is a further object of the invention to provide an improved process for the formation of a pyrolyzed carbonaceous filamentary material wherein the filamentary material undergoing thermal conversion may be readily handled within harmful results.

These and other objects, as well as the scope, nature, and utilization of the process will be apparent from the following description and appended claims.

SUMMARY OF THE INVENTION

It has been found that a process for producing a pyrolyzed carbonaceous filamentary material comprises:

a. providing a homogeneous molten blend comprising 1 part by weight of polystyrene and 0.25 to 1.5 part by weight of pitch, b. extruding the homogeneous molten blend through a spinneret, c. passing the resulting extruded molten blend in the direction of its length through a solidification zone provided with a gaseous atmosphere at a temperature below 80° C. wherein the extruded molten blend is transformed to a solid filamentary material, d. hot drawing the resulting solid filamentary material at least 2 times its as-spun length, e. thermally stabilizing the resulting hot drawn filamentary material to render the same capable of undergoing carbonization, the thermal stabilization comprising the sulfonation of the hot drawn filamentary material, and f. heating the resulting stabilized filamentary material to a temperature of at least 1000° C. in an inert atmosphere where it is maintained until a pyrolyzed carbonaceous filamentary material is formed which contains at least about 98 percent carbon by weight.

DESCRIPTION OF PREFERRED EMBODIMENTS

The starting material utilized in the process of the present invention is a homogeneous molten blend comprising 1 part by weight of polystyrene, and 0.25 to 1.5 parts by weight (preferably 0.3 to 0.6 part by weight) of pitch.

The polystyrene component of the blend consists primarily of recurring units of the formula $(C_6H_5CHCH_2)_n$, and may be formed by conventional techniques known in the art. Commercially available polystyrene of general purpose grade such as commonly employed in molding applications conveniently may be selected for utilization in the process. In a preferred embodiment of the process, the polystyrene component exhibits a number average molecular weight of about 200,000 to 300,000. The average molecular weight of a given polystyrene sample may be determined by osmotic pressure techniques, or by any other suitable polymer characterization technique. The polystyrene component of the blend is one of the least expensive synthetic polymeric resinous materials available and contains about 92 percent carbon by weight.

The pitch component of the starting material may be derived from a natural deposit or through the utilization of an appropriate distillation or oxidation process. The term "pitch" as used in the present process includes asphalt, blown asphalt, petroleum pitch (i.e., petroleum asphalt), coal tar pitch, wood-tar pitch, pine-tar pitch, petroleum slag, fatty acid pitch, cottonseed pitch, wood grease pitch, vegetable oil pitch, stearin pitch, Stockholm pitch, Archangel pitch, Gilsonite, PVC pitch, etc. The preferred pitches for utilization in the process of the present invention have a relatively high softening point in combination with a relatively high carbon content. For example, a preferred pitch for utilization in the process of the present invention is petroleum pitch, e.g., air blown petroluem pitch.

The pitch selected preferably has a softening point of about 70 to 150° C. (most preferably about 115 to 150° C.), a mean molecular weight of about 400 to 2000 (most preferably about 800 to 1200), contains about 86 to 97 percent by weight carbon (most preferably about 90 to 94 percent by weight carbon), a viscosity of about 2000 to 6000 cp. at 400° F. as determined by ASTM Designation D-2669, a coking value of about 34 to 65 percent as determined by ASTM Designation D-2416, and a benzene insolubles value of about 8 to 28 weight percent as determined by ASTM Designation D-2317.

The molten blend which is utilized as the starting material in the present process conveniently may be formed by heating an appropriate quantity of the polystyrene and the pitch above the softening point of each component and admixing the same until a homogeneous melt-spinnable blend results. For instance, the components may be formed into a preblend with the aid of a Banbury mixer, and subsequently passed through a homogenizer, e.g., a ZSK twin-screw extruder. The blend conveniently may be formed with components elevated to a temperature about 10 to 20° C. above the softening point of the polystyrene component. The molten blend may be blanketed with an inert atmosphere, e.g., a nitrogen atmosphere.

The spinneret selected for use in the process to form the filamentary material may contain one or preferably a plurality of extrusion orifices which are substantially circular in diameter. The spinneret may be the type commonly utilized in the melt spinning of fibers. For instance, a standard conical spinneret containing 1 to 200 holes (e.g. 6 to 200 holes) having a diameter of about 5 to 25 mils (e.g., 5 to 10 mils) may be utilized in the process. Yarns containing about 6 to 200 continuous filaments are commonly formed.

The homogeneous blend of polystyrene and pitch when supplied to the spinneret is provided in a molten state at a temperature which exceeds its softening point. In a preferred embodiment of the process of the blend is provided to the spinneret while at a temperature of about 10 to 40° C. above the softening point of the blend. In a preferred embodiment of the process the blend is provided at a temperature of about 180 to 220° C., and most preferably at a temperature of about 200 to 210° C. when extruded through the spinneret.

Upon extrusion through the spinneret the resulting extruded molten blend is passed in the direction of its length through a solidification zone provided with a gaseous atmosphere at a temperature below 80° C. wherein the extruded molten blend is transformed to a solid filamentary material. Within the solidification zone the molten blend passes from the melt to a semi-solid consistency, and from the semi-solid consistency to a solid consistency. The solidification zone could also be termed a "quench zone". The gaseous atmosphere present within the solidification zone preferably circulates so as to bring about more efficient heat transfer. In a preferred embodiment of the process of the gaseous atmosphere of the solidification zone is provided at a temperature of about 10 to 40° C., and most preferably at about room temperature (e.g., at about 25° C.). The chemical composition of the gaseous atmosphere of the solidification zone is not critical to the operation of the process provided the gaseous atmosphere is not unduly reactive with the filamentary material. In a particularly preferred embodiment of the process of the gaseous atmosphere of the solidification zone is air. Other representative gaseous atmospheres which may be selected for utilization in the solidification zone include nitrogen, argon, helium, etc.

The solidification zone is preferably disposed immediately below the spinneret and the extruded blend is present while axially suspended therein for a residence time sufficient to transform the molten blend to a solidified filamentary material. The gaseous atmosphere is preferably introduced at the lower end of the solidification zone and withdrawn along the side thereof with the moving continuous length of extruded filamentary material passing downwardly therethrough from the spinneret. A center flow quench or any other technique capable of bringing about the desired quench alternatively may be utilized.

The resulting solid filamentary material preferably is withdrawn from the solidification zone at a rate of about 100 to 1200 meters per minute (most preferably at a rate of about 300 to 800 meters per minute) while under a tension of about 0.001 to .05 gram per denier (most preferably 0.005 to 0.1 gram per denier).

The resulting solid filamentary material is hot drawn at least 2 times its as-spun length in order to impart molecular orientation and crystallinity to the same. Such hot drawing may be conducted while the solid filamentary material is in contact with a heated draw surface or is axially suspended in a heated gaseous atmosphere. Representative heated draw surfaces include hot shoes, hot pins, etc. In a preferred embodiment of the process the resulting solid filamentary material is hot drawn about 3 to 6 times its as-spun length while in contact with a heated draw surface maintained at about 85 to 125° C. The temperatures of the heated draw surface is preferably maintained below the point at which coalescence of adjoining filaments occurs. The nature of the gaseous atmosphere in contact with the filamentary material during the hot drawing is not critical to operation of the process provided it is not unduly reactive with the filamentary material, and conveniently may be air. The hot drawing step serves to align the pitch molecules and polystyrene molecules longitudinally along the length of the fiber. In a preferred embodiment of the process the filamentary material following hot drawing exhibits a denier per filament of about 1 to 10.

The resulting hot drawn filamentary material is thermally stabilized to render the same capable of undergoing carbonization without loss of its original fibrous configuration. The original fibrous configuration of the filamentary material is retained throughout the stabilization reaction. The filamentary material is subjected to a sulfonation reaction whereby its thermal stability is enhanced. Sulfonic acid groups, i.e., $-SO_3H$ groups, are imparted to polystyrene and pitch molecules of the filamentary material and the cross-linking of adjoining molecules takes place. Sulfone formation takes place and sulfur bridges are formed between molecules. The sulfonation reaction may be carried out in accordance with any one of a variety of available sulfonation procedures as will be apparent to those skilled in the art. Common sulfonating agents such as concentrated sulfuric acid, fuming sulfuric acid (olcum), sulfur trioxide, sulfur trioxide in liquid sulfur dioxide, alkali disulfates, pyrosulfates, chlorosulfonic acid, and a mixture of manganese dioxide and sulfurous acid may be utilized to bring about the desired sulfonation reaction. If desired, a minor quantity of a sulfonation catalyst, such as silver sulfate, may be incorporated within the filamentary material at the time the molten blend is formed. Alternatively, a sulfonation catalyst may be applied to the filamentary material following its formation.

The sulfonation reaction is preferably carried out through the utilization of fuming sulfuric acid. For instance, the filamentary material may be suspended in an enclosed zone above the surface of fuming sulfuric acid liquid which is provided at a temperature of about 20 to 100° C. for about 30 to 400 minutes with the reaction proceeding at a faster rate at the more elevated temperatures.

The residence time required to complete the sulfonation reaction will vary with the concentration of the sulfonating reagent, the temperature of the sulfonating reagent, and the degree of compaction of the resulting hot drawn filamentary material. The sulfonation reaction is preferably conducted at least until no softening of the filamentary material occurs when heated to 200° C.

In a particularly preferred embodiment of the process the resulting hot drawn filamentary material is thermally stabilized by (1) sulfonating the filamentary material at least until no softening of the filamentary material occurs when heated to 200° C., and (2) heating the previously sulfonated filamentary material in an oxygen-containing atmosphere at a temperature below the softening point thereof to further enhance its thermal stability. When such a multiple step stabilization procedure is utilized, it is not necessary that initial sulfonation reaction reach absolute completion. The oxygen-containing atmosphere imparts additional thermal stability to the previously sulfonated filamentary material, primarily through an oxidative cross-linking reaction of adjoining molecules. Representative oxygen-containing atmospheres include pure oxygen, air, mixtures of air and oxygen, ozone, etc. The temperature of the oxygen-containing atmosphere will vary with the degree of sulfonation achieved and is maintained below the softening point of the filamentary material. When the stabilization reaction involves heating in an oxygen-containing atmosphere, such atmosphere is preferably maintained at or near the maximum temperature which can be tolerated by the filamentary material without loss of its original fibrous configuration. For instance, when a simple air atmosphere is selected, the air is maintained within the range of about 200° to 300° C. and below the softening point of the filamentary material. As the thermal stabilization reaction progresses it is possible for the filamentary material to withstand increasingly elevated temperatures without loss of its original fibrous configuration. Accordingly, the gaseous atmosphere may be provided at an increasingly elevated temperature provided the softening point then exhibited by the filamentary material is not exceeded and the original fibrous configuration of the same retained. During the stabilization reaction a longitudinal tension preferably is maintained upon the filamentary material so that a substantially constant length is maintained.

The stabilized filamentary material is heated to a temperature of at least 1000° C. while present in an inert atmosphere where it is maintained until a pyrolyzed carbonceous fibrous material is formed which contains at least about 98 percent carbon by weight. Commonly, the filamentary material is heated to a maximum temperature within the range of about 100° to 1600° C. wherein a substantially amorphous carbonaceous fibrous material containing at least about 98 percent carbon by weight is formed. Suitable inert gaseous atmospheres in which the carbonization reaction is carried out include nitrogen, argon, and helium. Suitable carbonization residence times commonly range from about 10 seconds to 5 minutes, or more, depending upon the specific carbonization temperature. Alternatively, the stabilized filamentary material may be heated to a maximum temperature within the range of about 2000° to 3100° C. in an inert atmosphere where it is maintained until substantial graphitization has occurred. Temperature gradients may be utilized wherein both carbonization and graphitization are accomplished in the same heating zone, or the carbonization and graphitization zones may be distinct.

The equipment utilized to convert the stabilized filamentary material to a pyrolyzed carbonaceous fibrous material (i.e., either an amorphous carbon or a graphitic carbon fibrous material) may be varied as will be apparent to those skilled in the art. It is essential that the apparatus be capable of producing the required temperature while excluding the presence of an oxidizing atmosphere. In a preferred embodiment of the process a continuous length of a stabilized filamentary material is heated by use of an induction furnace. In such a procedure the filamentary material may be passed in the direction of its length through a hollow graphite tube or other susceptor which is situated within the windings of the induction coil. By varying the length of the graphite tube, the length of the induction coil, and the rate at which the filamentary material is passed through the graphite tube, many apparatus arrangements capable of carrying out the carbonization or carbonization and graphitization may be selected. For large scale production, it is of course preferred that relatively long tubes or susceptors be used so that the filamentary material may be passed through the same at a more rapid rate while being carbonized, or carbonized and graphitized. The temperature gradient of a given apparatus may be determined by conventional optical pyrometer measurements as will be apparent to those skilled in the art. The filamentary material because of its small mass and relatively large surface area instantaneously assumes essentially the same temperature as the heating zone through which it is continuously passed. When producing a pyrolyzed carbonaceous filamentary material which is formed of substantially amorphous carbon, the lower maximum temperatures required to form the same conveniently may be formed in a resistance heated furnace.

The pyrolyzed carbonaceous filamentary materials may be incorporated in a binder or matrix and serve as a reinforcing medium. The resulting filamentary materials may accordingly serve as a light weight load bearing component is high performance structures which find particular utility in the aerospace industry.

The process of the present invention for forming the pyrolyzed carbonaceous filamentary materials offers substantial advantages when compared with the prior art. The starting material is relatively inexpensive and has been found to be capable of efficient melt spinning. Because of the relatively high carbon content of the starting material, fewer off-gases are evolved, and the resulting filamentary product possesses fewer strength reducing voids. Severe processing constraints commonly encountered during the handling of a pitch filamentary material are effectively eliminated.

The following examples are given as specific illustrations of the process of the present invention. It should be understood, however, that the invention is not limited to the specific details set forth in the examples.

EXAMPLE 1

One part by weight of general purpose isotactic polystyrene, and 0.4 part by weight petroleum pitch are melted in a stirred vessel maintained at 160° C., and a homogeneous molten blend of the same is formed. The polystyrene has a number average molecular weight of about 250,000, exhibits a melting point of about 240° C., and contains about 92 percent carbon by weight. The pitch is commercially available from Ashland Oil Company under the designation Type 240, has a softening point of 118° C., a coking value of 52 percent a specific gravity of 1.22, and contains about 90 percent carbon by weight.

The molten blend of polystyrene and pitch while at a temperature of about 205° C. is extruded through a spinneret of the standard conical type possessing a ring of 20 extrusion holes, each having a diameter of 5 mils.

The resulting extruded molten blend is passed downwardly from the spinneret through a solidification zone having a length of 10 feet which is provided with a circulating air atmosphere at a temperature of about 25° C. While passing through the solidification zone the extruded blend is transformed into a continuous length of as-spun yarn. The blend is first transformed from a molten to a semi-solid consistency, and then from a semi-solid consistency to a solid consistency while passing through the solidification zone. The extruded blend is present in the solidification zone for a residence time of about 1 second.

The resulting yarn is withdrawn from the solidification zone at a rate of 200 meters per minute while under a stress of about 0.01 gram per denier. Elongation of the as-spun yarn takes place in the solidification zone to the extent that the filamentary material is drawn at a draw down ratio of about 4:1.

The resulting yarn is next hot drawn at a draw ratio of 3:1 upon passage over a 9 inch hot shoe maintained at 90° C. to which it is supplied at a rate of 20 meters per minute while under a longitudinal tension. An air atmosphere surrounds the heated draw surface and the resulting hot drawn yarn exhibits a denier per filament of about 1.5.

The resulting hot drawn yarn is thermally stabilized by (1) sulfonating the yarn, and (2) heating the sulfonated yarn in air at a temperature below the softening point thereof. More specifically, the hot drawn yarn is wound upon a stainless steel bobbin a thickness of one-sixteenth inch, and placed for 300 minutes in an enclosed glass lined vessel above the surface of liquid fuming sulfuric acid maintained at 40° C. Following the sulfonation reaction the yarn exhibits no softening when raised to a temperature of about 225° C. The yarn is next heated for 300 minutes in a circulating air oven in which it was heated from 200° C. to 00° C. at a rate of 20° C. per hour. The yarn is maintained at a constant length during the stabilization reaction. The resulting thermally stabilized yarn retains its original fibrous configuration substantially intact and is capable of undergoing carbonization.

The resulting stabilized yarn is continously passed at a rate of 1.5 inches per minute in the direction of its length through a Lepel induction furnace utilizing a 20 KW power source wherein both carbonization and graphitization are accomplished. The induction furnace comprises a 10 turn water cooled copper coil having an inner diameter of three-fourths inch and a length of 2 inches, and a hollow graphite tube or susceptor suspended within the coil having a length of 8½ inches, an outer diameter of one-half inch, and an inner diameter of one-eighth inch through which the yarn was continuously passed. The copper coil which encompasses a portion of the hollow graphite tube is positioned at a location essentially equidistant from the respective ends of the graphite tube. A stainless steel enclosure surrounds the induction furnace. A stream of nitrogen is continuously introduced into the stainless steel housing. Air is excluded from the heating zone by the outward flow of nitrogen through the orifices in the wall of the housing.

The stabilized yarn is at room temperature (i.e., about 250° C.) prior to introduction into the induction furnace. While passing through the graphite tube, the yarn is raised from about 25° C. to a temperature of 800° C. in approximately 85 seconds, from 800° C. to 1600° C. in approximately 52 seconds to produce a carbonized yarn, and from 1600° C. to a maximum temperature of approximately 2600° C. in approximately 28 seconds where it is maintained ±50° C. for approximately 66 seconds. While passing through the heating zone defined by the graphite tube a constant longitudinal tension of approximately 0.1 gram per denier is exerted upon the yarn, and a constant length is maintained.

The resulting yarn retains its original fibrous configuration essentially intact, contains in excess of 99 percent carbon by weight, and exhibits a graphitic carbon X-ray diffraction pattern. The yarn product is suitable for use as a reinforcing medium when incorporated in a resinous matrix material to form a lightweight composite article.

EXAMPLE II

Example I is repeated with the following exceptions.

0.5 part by weight of air blown petroleum pitch is utilized as the pitch component. The pitch has a softening point of about 145° C.

Substantially similar results are achieved.

Although the invention has been described with preferred embodiments, it is to be understood that variations and modifications may be resorted to as will be apparent to those skilled in the art. Such variations are to be considered within the purview and scope of the claims appended hereto.

We claim:

1. A process for producing a pyrolyzed carbonaceous filamentary material comprising:

a. providing a homogeneous molten blend comprising 1 part by weight of polystyrene exhibiting a number average molecular weight of about 100,000 to 300,000 and 0.25 to 1.5 part by weight of pitch exhibiting a mean molecular weight of about 400 to 2,000, b. extruding said homogeneous molten blend through a spinneret having at least one extrusion orifice, c. passing the resulting extruded molten blend in the direction of its length through a solidification zone provided with a gaseous atmosphere at a temperature below 80° C. wherein said extruded molten blend is transformed to a solid filamentary material, d. hot drawing said resulting solid filamentary material at least 2 times its as-spun length while maintained below the temperature at which coalescence of filaments occurs, e. thermally stabilizing said resulting hot drawn filamentary material to render the same capable of undergoing carbonization, said thermal stabilization comprising the sulfonation of said hot drawn filamentary material, and f. heating said resulting stabilized filamentary material to a temperature of at least 1000° C. in an inert atmosphere where it is maintained until a pyrolyzed carbonceous filamentary material is formed which contains at least about 98 percent carbon by weight.

2. A process for producing a pyrolyzed carbonaceous filamentary material according to claim 1 wherein said homogeneous molten blend comprises 1 part by weight of polystyrene and 0.3 to 0.6 part by weight of pitch.

3. A process for producing a pyrolyzed carbonaceous filamentary material according to claim 1 wherein said pitch is petroleum pitch.

4. A process for producing a pyrolzyed carbonaceous filamentary material according to claim 1 wherein said homogeneous molten blend is at a temperature of about 10 to 40° C. above the softening point of the blend when extruded through said spinneret.

5. A process for producing a pyrolyzed carbonaceous filamentary material according to claim 1 wherein said gaseous atmosphere of said solidification zone is provided at a temperature of about 10 to 40° C.

6. A process for producing a pyrolyzed carbonaceous filamentary material according to claim 1 wherein said gaseous atmosphere of said solidification zone is air.

7. A process for producing a pyrolyzed carbonaceous filamentary material according to claim 1 wherein said filamentary material is a yarn consisting of about 6 to 200 filaments.

8. A process for producing a pyrolyzed carbonaceous filamentary material according to claim 1 wherein said resulting solid filamentary material is hot drawn about 3 to 6 times its as-spun length while in contact with a heated draw surface maintained at about 85 to 125° C.

9. A process for producing a pyrolyzed carbonaceous filamentary material according to claim 1 wherein said filamentary material following said hot drawing exhibits denier per filament of about 1 to 10.

10. A process for producing a pyrolyzed carbonaceous filamentary material according to claim 1 wherein said sulfonation of hot drawn filamentary material is conducted in the presence of fuming sulfuric acid.

11. A process for producing a pyrolyzed carbonaceous filamentary material according to claim 10 wherein said fuming sulfuric acid is provided at a temperature of about 20 to 100° C. when reacted with said hot drawn filamentary material.

12. A process for producing a pyrolyzed carbonaceous filamentary material according to claim 1 wherein said thermal stabilization of said resulting hot drawn filamentary material comprises heating the previously sulfonated filamentary material in an oxygen-containing atmosphere at a temperature below the softening point thereof.

13. A process for producing a pyrolyzed carbonaceous filamentary material according to claim 1 wherein said resulting stabilized filamentary material is heated in an inert atmosphere selected from the group consisting of nitrogen, argon, and helium.

14. A process for producing a pyrolyzed carbonaceous filamentary material according to claim 1 wherein stabilized filamentary material is heated to a maximum temperature within the range of about 2000 to 3100° C. in an inert atmosphere where it is maintained until substantial graphitization has occurred.

15. A process for producing a pyrolyzed carbonaceous filamentary material comprising:

a. providing a homogeneous molten blend comprising 1 part by weight of polystyrene exhibiting a number average molecular weight of about 200,000 to 300,000, and 0.25 and 1.5 part by weight of pitch exhibiting a mean molecular weight of about 800 to 1200, b. extruding said homogeneous blend while at a temperature of about 180 to 220° C. through a spinneret containing at least one extrusion orifice having a diameter of about 5 to 25 mils, c. passing the resulting extruded blend in the direction of its length through a solidification zone provided with a gaseous atmosphere at a temperature of about 10 to 40° C. wherein said extruded molten blend is transformed to a solid filamentary material, d. hot drawing said resulting solid filamentary material about 3 to 6 times its as-spun length while in contact with a heated draw surface maintained at about 85 to 125° C., e. thermally stabilizing said resulting hot drawn filamentary material comprising (1) sulfonating said filamentary material at least until no softening of the filamentary material occurs when heated to 200° C.; and (2) heating said sulfonated filamentary material in air maintained within the range of about 200 to 300° C. and below the softening point thereof until said filamentary material is rendered capable of undergoing carbonization, and f. heating said resulting stabilized filamentary material to a temperature of at least 1000° C. in an inert atmosphere where it is maintained until a pyrolyzed carbonaceous filamentary material is formed which contains at least about 98 percent carbon by weight.

16. A process for producing a pyrolyzed carbonaceous filamentary material according to claim 15 wherein said gaseous atmosphere of said solidification zone is air.

17. A process for producing a pyrolyzed carbonaceous filamentary material according to claim 15 wherein said filamentary material is a yarn consisting of about 6 to 200 filaments.

18. A process for producing a pyrolyzed carbonaceous filamentary material according to claim 15 wherein said filamentary material following said hot drawing exhibits a denier per filament of about 1 to 10.

19. A process for producing a pyrolyzed carbonaceous filamentary material according to claim 15 wherein said sulfonation is conducted in the presence of fuming sulfuric acid.

20. A process for producing a pyrolyzed carbonaceous filamentary material according to claim 15 wherein said resulting stabilized filamentary material is heated in an inert atmosphere selected from the group consisting of nitrogen, argon, and helium.

21. A process for producing a pyrolyzed carbonaceous filamentary material according to claim 15 wherein stabilized filamentary material is heated to a maximum temperature within the range of about 2000 to 3100° C. in an inert atmosphere where it is maintained until substantial graphitization has occurred.

* * * * *